US009009875B2

(12) United States Patent
Smashey et al.

(10) Patent No.: US 9,009,875 B2
(45) Date of Patent: Apr. 21, 2015

(54) LOCKING APPARATUS FOR LAVATORY PLUMBING FIXTURES

(75) Inventors: Bill Smashey, El Cajon, CA (US); Dan Vincent, Lakeside, CA (US); Jaime Vincent, Lakeside, CA (US)

(73) Assignee: Fabcon Products, LLC, Lakeside, CA (US)

( * ) Notice: Subject to any disclaimer, the term of this patent is extended or adjusted under 35 U.S.C. 154(b) by 893 days.

(21) Appl. No.: 13/102,977

(22) Filed: May 6, 2011

(65) Prior Publication Data

US 2011/0271434 A1 Nov. 10, 2011

Related U.S. Application Data

(60) Provisional application No. 61/332,672, filed on May 7, 2010.

(51) Int. Cl.
*A47K 13/00* (2006.01)
*A47K 13/24* (2006.01)

(52) U.S. Cl.
CPC ..... *A47K 13/242* (2013.01)

(58) Field of Classification Search
CPC ..... A47K 13/242
USPC ..... 4/253; 70/292, 63, 144, 466, 91, 456, 70/50; D08/331; 312/333; 292/307
See application file for complete search history.

(56) References Cited

U.S. PATENT DOCUMENTS 2,404,124 A * 7/1946 Des Roches ..... 292/259 R
2,431,263 A * 11/1947 Lundgren ..... 4/236
2,529,587 A * 11/1950 Bates et al. ..... 4/255.01
2,578,153 A * 12/1951 Schmitz ..... 4/236
2,651,053 A * 9/1953 Rowe et al. ..... 4/253
2,698,439 A * 1/1955 Bruckner ..... 4/253
2,724,125 A * 11/1955 Williams ..... 4/253
2,886,826 A * 5/1959 Shaleen ..... 4/420
2,996,731 A * 8/1961 Leptrone ..... 4/253
3,024,472 A * 3/1962 Hardenbrook ..... 4/253
3,346,888 A * 10/1967 Paysinger ..... 4/253
3,477,070 A * 11/1969 Kimber ..... 4/253
4,145,771 A * 3/1979 Khazin ..... 4/253
4,296,504 A * 10/1981 Lawson ..... 4/253
4,319,368 A * 3/1982 Peters ..... 4/661
4,395,784 A * 8/1983 Foster ..... 4/236
4,502,167 A * 3/1985 Porzelius ..... 4/253
4,507,813 A * 4/1985 Lawson et al. ..... 4/253
4,524,470 A * 6/1985 Grenell ..... 4/253
4,575,879 A * 3/1986 Cabral et al. ..... 4/253
4,649,576 A * 3/1987 Lillie ..... 4/246.5
4,651,358 A * 3/1987 Logan, Jr. ..... 4/253
4,658,447 A * 4/1987 Smith ..... 4/236
4,724,551 A * 2/1988 Gardner ..... 4/253
4,736,472 A * 4/1988 Buckshaw et al. ..... 4/253
4,763,363 A * 8/1988 Lallemand ..... 4/253
4,833,737 A * 5/1989 Boucher et al. ..... 4/253
4,894,870 A * 1/1990 Buckshaw et al. ..... 4/253

(Continued)

*Primary Examiner* — Lori Baker

(74) *Attorney, Agent, or Firm* — Coastal Patent Law Group, P.C.

(57) ABSTRACT

A lock for lavatory plumbing fixtures includes one or more griping members adapted to receive and attach to an internal rim of the lavatory fixture bowl. At least one of the gripping members can be translationally adapted or slideably engaged. A keyed rotational lock or a padlock can be incorporated for locking the article in place. Alternatively, a screw having a special head can be utilized to prevent unauthorized unlocking of the article.

18 Claims, 4 Drawing Sheets

(56) References Cited

U.S. PATENT DOCUMENTS

| | | | | | |
|---|---|---|---|---|---|
| 4,930,166 | A | * | 6/1990 | Salloum | 4/253 |
| 5,003,641 | A | * | 4/1991 | Selman, Jr. | 4/253 |
| 5,056,177 | A | * | 10/1991 | Nast | 15/104.33 |
| 5,347,663 | A | * | 9/1994 | Yost | 4/253 |
| D372,965 | S | * | 8/1996 | Villeneuve | D23/311 |
| 5,669,081 | A | * | 9/1997 | Scherer et al. | 4/253 |
| 5,682,776 | A | * | 11/1997 | Burt | 70/159 |
| 6,108,827 | A | * | 8/2000 | Espadas | 4/253 |
| 6,173,454 | B1 | * | 1/2001 | Alvarez | 4/242.1 |
| 6,226,805 | B1 | * | 5/2001 | Watkins | 4/253 |
| 6,314,589 | B1 | * | 11/2001 | Schilt | 4/253 |
| 6,470,503 | B1 | * | 10/2002 | Holmes | 4/246.1 |
| 2003/0024038 | A1 | * | 2/2003 | Cross et al. | 4/253 |
| 2007/0061954 | A1 | * | 3/2007 | Watkins | 4/253 |
| 2007/0079431 | A1 | * | 4/2007 | Junkins | 4/253 |
| 2007/0250997 | A1 | * | 11/2007 | McDonald et al. | 4/253 |
| 2009/0019626 | A1 | * | 1/2009 | Sullivan | 4/253 |
| 2009/0049591 | A1 | * | 2/2009 | Orona, Jr. | 4/253 |
| 2011/0308000 | A1 | * | 12/2011 | Tseng | 4/253 |

* cited by examiner

LOCKING APPARATUS FOR LAVATORY PLUMBING FIXTURES

CROSS REFERENCE TO RELATED APPLICATIONS

This application claims benefit of priority to U.S. Provisional Ser. No. 61/332,672, filed May 7, 2010, titled "LOCKING APPARATUS FOR LAVATORY PLUMBING FIXTURES", the entire contents of which are hereby incorporated by reference.

FIELD OF THE INVENTION

This invention relates to security and locking devices, and more particularly to locking devices for lavatory plumbing fixtures for use in the construction and facilities maintenance industries.

BACKGROUND OF THE INVENTION

Lavatory plumbing fixtures, such as sinks, toilets, urinals, and other plumbing fixtures are widely known and used in the art. Commercial buildings, resorts, hotels, homes, and other buildings which incorporate the use of lavatory plumbing fixtures continue to be built or remodeled in increasing numbers. Along with expansion of new construction and remodel projects comes a need for lavatory rooms and contained plumbing fixtures.

One problem in the field, especially in view of large construction and remodel projects, includes the extended delay of time occurring between delivery, prep, install, and certification of plumbing fixtures for use by individuals. Typically, several days to a week or more may lapse between the initial delivery and certification of lavatory plumbing fixtures. During this interval, several construction crews may become present at a job site, such as painters, dry wall installers, engineers, flooring technicians, plumbers and the like. As work continues daily, these workers encounter lavatory rooms and often utilize lavatory plumbing fixtures prematurely. Unfortunately, there is a large problem with the use of lavatory plumbing fixtures prior to proper installation and certification of these fixtures.

There is a need in the field of construction for a cost-effective apparatus for communicating the presence of an uninstalled lavatory plumbing fixture. There is further a need for a locking apparatus for communicating a temporary service outage and protecting non-functional fixtures from unauthorized use. Further there is a need for an apparatus which locks to prevent the use of these lavatory plumbing fixtures when such a use would otherwise give rise to problematic results. Still further there is a need for a lavatory plumbing fixture accessory which is durable and designed for repeated use.

SUMMARY OF THE INVENTION

It is therefore an object of the invention to provide an apparatus for securely locking and preventing unauthorized use of lavatory plumbing fixtures, the apparatus being cost-effective and suitable for repeated use in construction related projects.

In one embodiment of the invention, an article of manufacture includes a lavatory fixture lock, the fixture lock comprising a planar body adapted to substantially cover a toilet bowl when placed thereon. The planar body may comprise structural support ribs on one or both of a top and bottom surface of the planar body. The planar body further comprises two or more slots, and preferably four slots, etched, molded, or otherwise fabricated thereon. Two or more gripping members are perpendicularly attached to the planar body at a bottom surface, each of the gripping members adapted to receive a screw or other attachment member extending from the top surface of the planar body, through the slot portion, and into the gripping member. In this regard, the gripping members can be tightened or loosened by the screw or attachment member. With the screw in an unthreaded position (loose), the gripping member is configured to slideably translate radially from a locked position to an unlocked position, wherein the gripping member is slideably extended radially outwardly to effectuate the locked position. In this embodiment, the fixture lock is adapted to lock by gripping the rim of an interior portion of the fixture bowl, such that the fixture cannot be used prior to removing the fixture lock.

In another embodiment, the fixture lock utilizes the fixture lid or cover to prevent unauthorized use. In this embodiment, the fixture lock comprises a first gripping member attached to a first radial extension arm extending therefrom, and a second gripping member having a second radial extension arm therefrom. The first and second radial extension arms are adapted for attachment with one another using a ring and ring slot, or other locking means. In this regard, the first gripping member and extension arm is set on an internal rim portion of the fixture bowl, the second gripping member is set on another rim portion of the fixture bowl opposite of the first gripping member, the lid or cover is closed and the extension arms are set above the cover such that the arms are locked together, for example using a padlock inserted between a ring and a ring slot portion of the extension arms.

In another embodiment, the fixture lock comprises two gripping members for attaching to an interior rim portion of the fixture bowl, one or more extension arms, and a planar body attached thereto. In this regard, a ring portion attached to an extension arm can extend through a slot portion of the planar body, and a padlock or other lock can attach to the ring portion for effectively locking the plumbing fixture and preventing unauthorized use thereof.

In yet another embodiment, a planar body is adapted to substantially cover a lavatory fixture, the planar body comprising a rotational lock adapted to receive a key. The rotational lock further comprises two or more, and preferably three radial arms. The radial arms are each inserted through an aperture of a radial support tab such that upon rotation of the lock, the radial arms are adapted to extend and retract through the aperture of the radial support tabs for effectively locking and unlocking the article with an interior rim portion of the fixture bowl. The radial arms and radial support structures collectively defining an actuating gripping member.

Other embodiments and key features will be thoroughly discussed in the detailed description, however it should be understood that although particular illustrative examples are described herein, these examples are provided for explanation and not limitation, accordingly one having skill in the art will understand that certain features can be altered to produce similar results without deviating from the spirit and scope of the invention.

BRIEF DESCRIPTION OF THE DRAWINGS

These and other attributes of the invention are further described in the following detailed description, particularly when reviewed in conjunction with the drawings, wherein.

DETAILED DESCRIPTION

Figure 1:
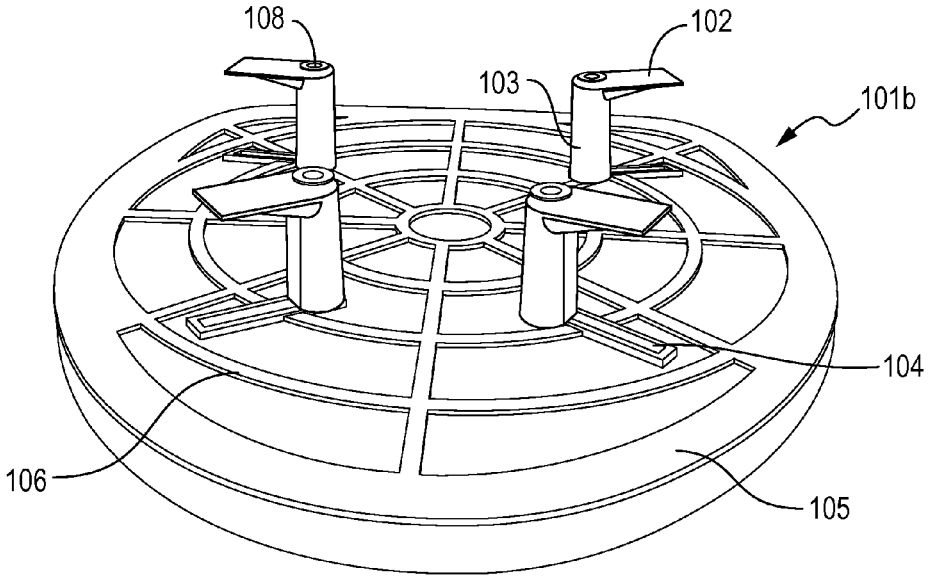
FIG. 1 illustrates a bottom perspective view of a plumbing fixture lock having a planar body and multiple slot portions aligned radially outward for permitting one or more slideably engaged gripping members to engage and lock with an inner rim portion of a fixture bowl.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions without departing from the spirit and scope of the invention. Certain embodiments will be described below with reference to the drawings wherein illustrative features are denoted by reference numerals.

In a general embodiment of the invention, an article of manufacture includes a lavatory plumbing fixture lock. The fixture lock comprises: a first gripping member comprising a first vertical portion, and a first horizontal portion extending substantially perpendicularly outward from said first vertical portion. The first griping member being adapted to receive a first internal rim portion of a fixture. The lock further comprises a second gripping member comprising a second vertical portion and a second horizontal portion thereof being adapted to receive a second internal rim portion of the fixture. Each of the first and second gripping members being individually connected to a planar body, or an extension arm, wherein the lavatory fixture lock is adapted to prevent unauthorized use of the fixture.

Multiple embodiments of a lavatory fixture lock are described herein, though it should be noted that several other embodiments may be fabricated upon implementing various features further described herein.

Figure 2:
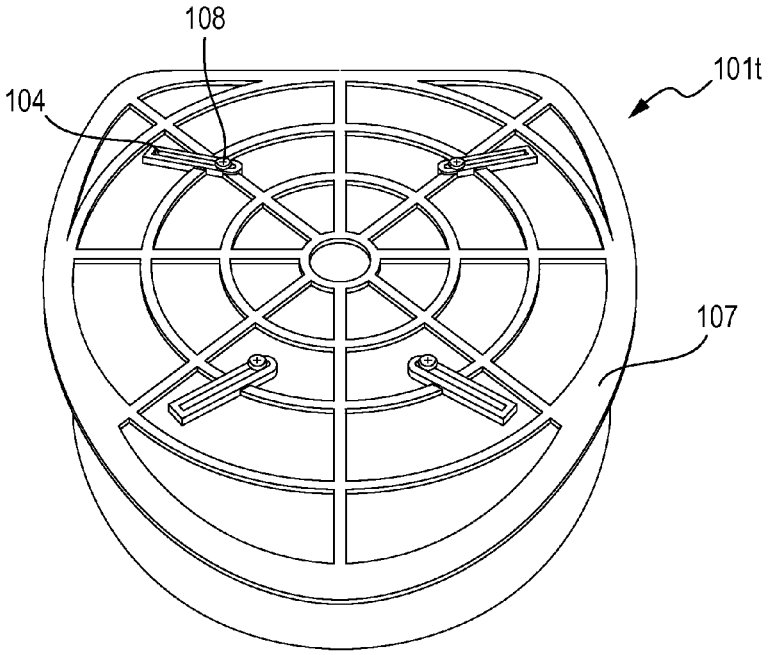
FIG. 2 illustrates a top perspective view of the fixture lock of FIG. 1*a*.

Now turning to the figures, FIGS. 1-2 illustrate a lavatory fixture lock according to one embodiment of the invention. The fixture lock comprises a planar body 105 having a top surface 101*t* and a bottom surface 101*b* thereof. One or more slots 104 are disposed on the planar body and oriented to extend radially outwardly thereon. Preferably four slots are provided as illustrated in FIGS. 1-2. At each of the slots is further disposed a gripping member comprising a vertical portion 103 extending outwardly from the slot surface, and a horizontal portion 102 extending outwardly from the vertical portion. The vertical and horizontal portions collectively defining the gripping member, wherein the gripping member is adapted to receive a portion of an internal rim of a fixture bowl. The lock can further comprise one or more structural ribs 106 for lightweight support and rigidity, the ribs being disposed on one or both of the top and bottom surfaces of the planar body.

Each gripping member can be slideably engaged with a slot of the planar body, wherein a screw or other attachment member extends from the top surface of the planar body through the slot to connect to the slideably engaged gripping member. In this regard, the gripping member is capable of radial translation along the slot portion, and further capable of being secured by a tightening of the screw 108 or attachment member. Likewise, the fixed gripping member can be loosened for translational release (unlocking).

Figure 3:
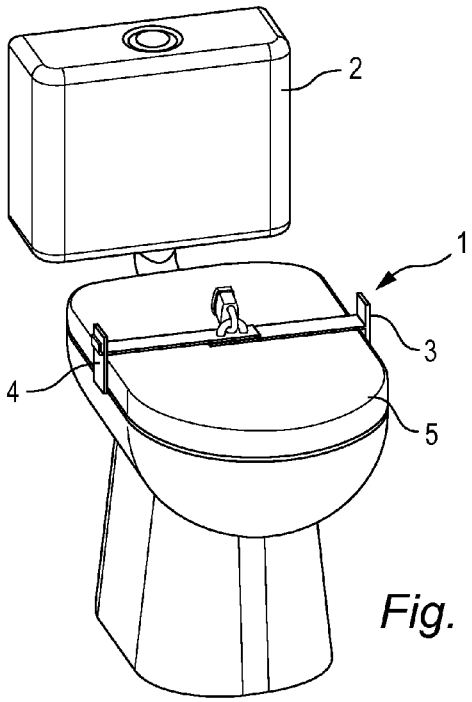
FIG. 3 illustrates a typical lavatory fixture and a fixture lock according to one embodiment of the invention, the fixture lock is adapted to secure the fixture lid or cover for preventing unauthorized use of the fixture, a padlock is provided for locking the fixture.
Figure 4:
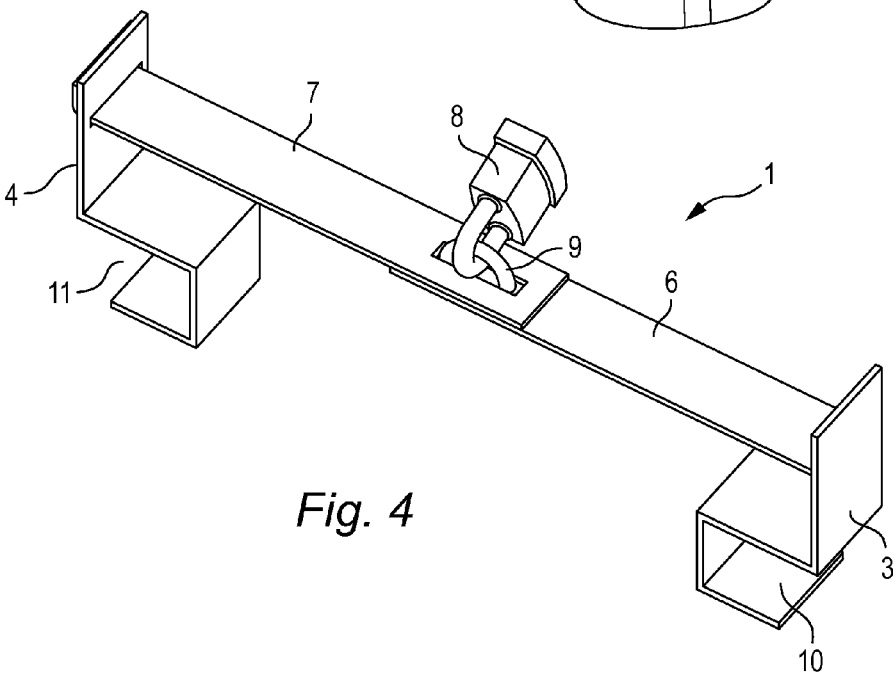
FIG. 4 illustrates a perspective view of the fixture lock of FIG. 3.

In another embodiment according to FIGS. 3-4, a lavatory fixture lock 1 is adapted to securely fasten a lid 5 or cover of the fixture 2 to prevent unauthorized use thereof. The fixture lock 1 comprises a first gripping member 10 connected to a first extension arm 6 at a proximal end. The first gripping member has a vertical portion and a horizontal portion extending outwardly therefrom. The first extension arm further comprises a ring portion 9 attached thereto at a distal end. The second gripping member 11 is further connected to a second extension arm 7 at a proximal end thereof. The second gripping member further includes an arm slot for receiving a portion of the second extension arm, and a ring slot for receiving a portion of the ring portion 9 of the first extension arm. The fixture lock is adapted such that the ring portion 9 of the first extension arm 6 is configured to protrude through the ring slot of the second extension arm 7 such that a padlock 8 can secure the fixture lock in place for preventing unauthorized use of the fixture. Furthermore, the fixture lock is adapted to grip one or more portions of the internal rim of the fixture bowl, and conform about the seat and lid of the fixture for effectively locking the lid of the fixture in a closed position.

Figure 5:
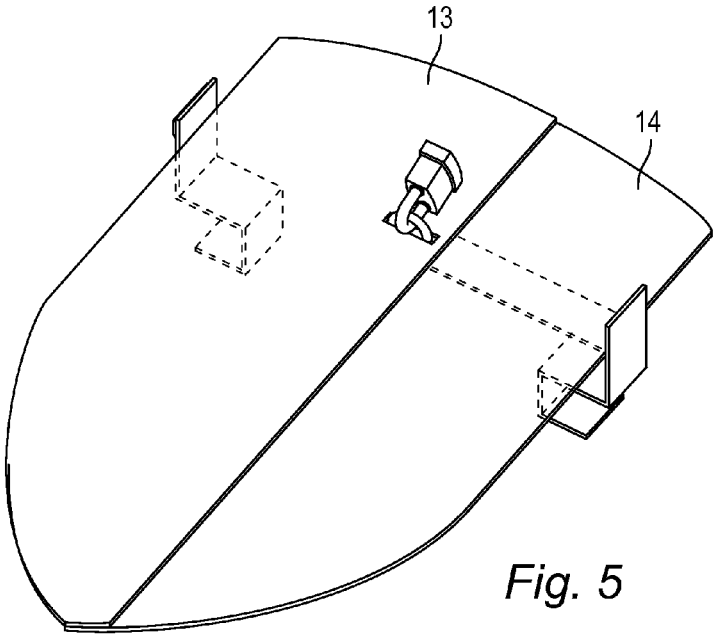
FIG. 5 illustrates an alternative article for locking a lavatory fixture according to certain embodiments of the invention, the fixture lock comprises a planar body, two gripping members, and a padlock for preventing unauthorized use of a lavatory fixture.

In another embodiment according to FIG. 5, the fixture lock is substantially similar to the embodiment of FIGS. 3-4, above, with the added feature of a planar body connected to one or more of the gripping members. In the embodiment of FIG. 5, a first planar body portion 13 includes a ring slot and is connected to a first gripping member. A second planar body portion 14 is connected to a second gripping member and a ring portion, such that the ring portion is adapted to be received by the ring slot and a padlock affixed therebetween. In this regard, one or more of the extension arms of the previous embodiment can further include a planar body. The planar body is not required to be provided in two or more portions since a single planar body can comprise the ring slot and an extension arm with a ring portion can protrude therethrough. Other embodiments are easily conceived by those having skill in the art.

Figure 6:
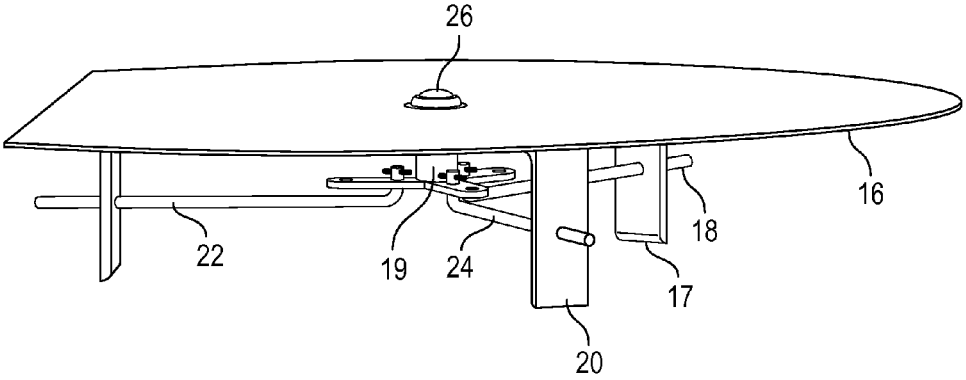
FIG. 6 illustrates a lavatory fixture lock according to certain embodiments of the invention, the fixture lock comprises a planar body having a keyed rotational lock disposed near a center of the planar body, the rotational lock is further connected to two or more radial rams, and each radial arm extends through an aperture of a radial support tab, such that rotation of the lock actuates the radial arms through the support tabs for translating into a locking position about an inner rim portion of a fixture bowl.
Figure 7:
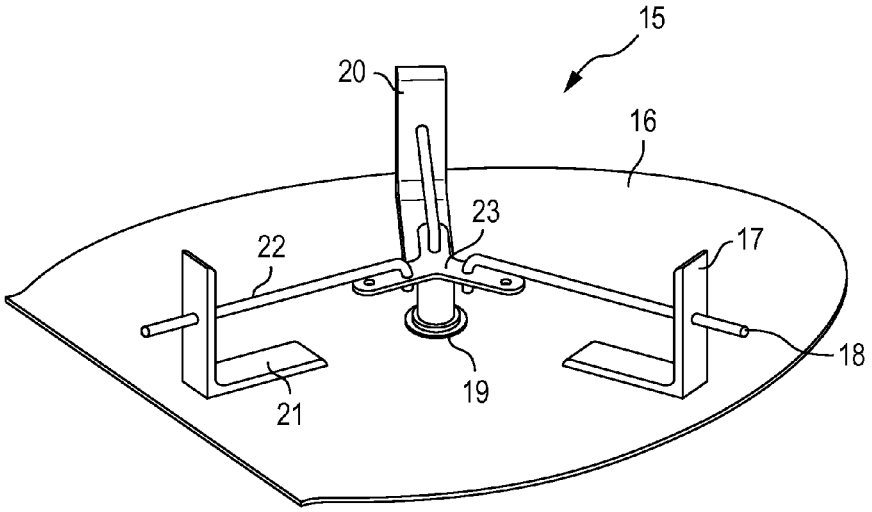
FIG. 7 illustrates the fixture lock of FIG. 6 in a locked position, wherein each of the radial arms is extended outwardly to lock the article about a rim portion of the fixture bowl.
Figure 8:
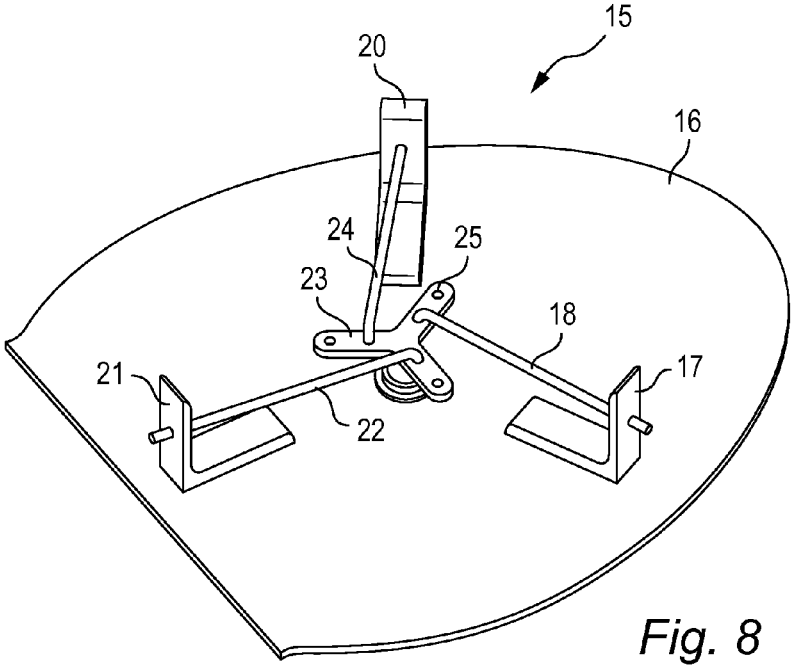
FIG. 8 further illustrates the fixture lock of FIG. 6 in an unlocked position, wherein each of the radial arms are rotationally retracted for unlocking the article and disengaging the lock from the fixture bowl.

In yet another embodiment according to FIGS. 6-8, a lavatory fixture lock 15 comprises a plurality of griping members, wherein each of the gripping members is defined by a vertical support tab 17 extending from a bottom surface of a planar body 16, the support tab 17 further comprising an aperture, and a radial arm 18 extending radially outwardly from a rotational lock 19 and through the aperture of the support tab, such that a rotation of the lock actuates the radial arm to extend and retract about the support tab through the aperture thereof. The rotational lock can further comprise a key portion 26 disposed at a top surface of the planar body, and a bracket 23 for receiving a proximal end of one or more radial arms 18; 22; 24. In the embodiments of FIGS. 6-8, three support tabs 17; 20; 21 are each disposed radially distl from a center point of the planar body. Each of the support tabs further comprises an aperture for receiving a portion of the radial arms 18; 22, 24. In this regard, the rotational lock is adapted to receive a key, rotate about an axis perpendicular to the planar body, and actuate the one or more radial arms between an extended (locked) position as illustrated in FIG. 7, and a retracted (unlocked) position as illustrated in FIG. 8.

In other embodiments of the invention, A lavatory fixture lock, comprises a rigid planar body comprising one or more support ribs disposed on at least one surface thereof, and at least one slot portion. At least two gripping members are further attached to the planar body, each of the griping members individually comprising a vertical portion extending outwardly from a surface of the planar body, and a horizontal portion extending outwardly from said vertical portion. At least one of the gripping members is slideably engaged with a slot portion of the planar body. Wherein each of the gripping members are individually adapted to receive at least a portion of a fixture rim for locking the fixture lock thereon.

In another embodiment, a lavatory fixture lock comprises a planar body adapted to substantially cover a rim portion of a fixture. The planar body further comprising one or more slots oriented radially outwardly therefrom. At least one gripping member is provided, the gripping member being adapted for slideable engagement at one of the slots. Wherein the planar body and gripping member are adapted to engage a fixture for preventing unauthorized use thereof.

In certain embodiments where a screw or other attachment member is utilized, the screw can utilize a special head for preventing the unauthorized unlocking of the gripping members. Those having skill in the art will recognize screws for appropriate use with the lavatory lock.

In certain other embodiments, the gripping members can further comprise one or more extrusions for extending into a slot portion of the planar body. In this regard, the gripping members can be configured to prevent rotation within the slot. Thus, the gripping members can be oriented outwardly toward the rim portion of the fixture bowl.

The above examples are set forth for illustrative purposes and are not intended to limit the spirit and scope of the invention. One having skill in the art will recognize that deviations from the aforementioned examples can be created which substantially perform the same functions and obtain similar results.

We claim:

1. A lavatory fixture lock, comprising:

a first gripping member comprising a first vertical portion, and a first horizontal portion extending substantially perpendicularly outward from said first vertical portion, said first griping member adapted to receive a first internal rim portion of a fixture;

a second gripping member comprising a second vertical portion and a second horizontal portion thereof adapted to receive a second internal rim portion of said fixture;

each of said first and second gripping members being individually connected to a planar body or a bracket; and each of said first and second gripping members being configured to actuate from a first unlocked position to a second locked position about the planar body or bracket;

wherein said griping members are configured to engage the internal rim portion when in the second locked position for preventing unauthorized use of said fixture.

2. The lavatory fixture lock of claim 1, said planar body comprising a plurality of slots, each of the slots being oriented radially with respect to a center of the planar body, wherein said first gripping member is slideably engaged with a first slot of the plurality of slots of said planar body.

3. The lavatory fixture lock of claim 2, wherein said first griping member extends outwardly from a bottom surface of said planar body at said first slot, and wherein a screw extends through a top surface of said planar body at said first slot, said screw being in threaded connection with said first gripping member for securing said first gripping member at a fixed translational distance about the first slot.

4. The lavatory fixture lock of claim 3, wherein at least the first horizontal portion of said first gripping member is adapted for slideable actuation to engage said internal rim portion.

5. The lavatory fixture lock of claim 4, wherein said planar body further comprises one or more support ribs on at least one surface of said top and bottom surfaces.

6. The lavatory fixture lock of claim 1, wherein said first gripping member is connected to a first extension arm, and said second gripping member is connected to a second extension arm.

7. The lavatory fixture lock of claim 6, wherein said first gripping member is connected to said first extension arm at a proximal end of said first arm, and said first extension arm further comprises a ring portion disposed at a distal end of said first arm.

8. The lavatory fixture lock of claim 7, wherein said second gripping member is connected to said second extension arm at a proximal end of said second arm, and said second extension arm further comprises a ring slot disposed at a distal end of said second arm.

9. The lavatory fixture lock of claim 8, wherein said ring slot of said second arm is adapted to receive at least a portion of said ring of said first arm therethrough, and wherein said ring protruding through said ring slot is adapted for locking with a padlock.

10. The lavatory fixture lock of claim 9, wherein one or more of said first and second gripping members further comprises an arm slot for receiving at least a portion of one of said arms therethrough.

11. The lavatory fixture lock of claim 10, wherein at least one of said first and second extension arms further includes a planar body.

12. The lavatory fixture lock of claim 1, wherein each of said first and second gripping members comprises a support tab and a radial arm, said support tab extending vertically from said planar body and being connected therewith, said support tab further comprising an aperture, said radial arm connected to a rotational lock at a proximal end and extending radially outwardly through said aperture of said support tab toward a distal end.

13. The lavatory fixture lock of claim 12, said rotational lock being disposed near a center of said planar body.

14. The lavatory fixture lock of claim 13, wherein said rotational lock is adapted to actuate said radial arms between an extended locked position and a retracted unlocked position.

15. A lavatory fixture lock, comprising:

a planar body adapted to substantially cover a rim portion of a fixture;

said planar body further comprising one or more slots extending outwardly from a center portion of the planar body;

at least one gripping member adapted for slideable engagement at one of said one or more slots;

wherein said planar body and gripping member are adapted to engage a fixture for preventing unauthorized use thereof.

16. A lavatory fixture lock, comprising:

a planar body; and a locking mechanism adapted to secure said planar body to a plumbing fixture, the locking mechanism comprising at least:

one or more gripping members configured to extend horizontally outward in a direction parallel with the planar body from a first unlocked position to a second locked position;

wherein said gripping members are further configured to engage at least a portion of an internal rim of the fixture when in the second locked position.

17. The lavatory fixture lock of claim 16, wherein at least one of said one or more gripping members is coupled to the planar body at a slot thereof, said gripping member being coupled to the planar body via a screw extending from a top surface of the planar body, through the slot, and into the one of said one or more gripping members; and wherein said one of said gripping members is configured to slideably translate about the slot from the first unlocked position to the second locked position.

18. The lavatory fixture lock of claim 16, comprising a keyed rotating lock extending through the planar body, and one or more radial arms coupled to the keyed rotating lock, said one or more radial arms extending outwardly therefrom; wherein said one or more radial arms are each configured to actuate from the first unlocked position to the second locked position.

* * * * *